US006421923B1

(12) United States Patent
Nguyen

(10) Patent No.: US 6,421,923 B1
(45) Date of Patent: Jul. 23, 2002

(54) CARPET TRIMMER

(75) Inventor: Tan Dinh Nguyen, San Jose, CA (US)

(73) Assignee: Crain Cutter Company, Milpitas, CA (US)

( * ) Notice: Subject to any disclaimer, the term of this patent is extended or adjusted under 35 U.S.C. 154(b) by 0 days.

(21) Appl. No.: 09/920,371

(22) Filed: Jul. 31, 2001

(51) Int. Cl.[7] ..... B26B 5/00; B26B 29/00
(52) U.S. Cl. ..... 30/287; 30/293; 30/294
(58) Field of Search ..... 30/287, 293, 294

(56) References Cited

U.S. PATENT DOCUMENTS

| | | | | | |
|---|---|---|---|---|---|
| 2,772,474 | A | * | 12/1956 | Hill et al. | 30/293 |
| 3,363,314 | A | * | 1/1968 | O'Brien | 30/293 |
| 3,395,453 | A | * | 8/1968 | Prater | 30/293 |
| 3,535,786 | A | * | 10/1970 | Sanders | 30/293 |
| 3,581,397 | A | * | 6/1971 | Kochanowski | 30/293 |
| 3,605,267 | A | * | 9/1971 | Brenner | 30/293 |
| 3,934,341 | A | * | 1/1976 | Carlson | 30/287 |
| 4,095,341 | A | | 6/1978 | Crain | |

* cited by examiner

*Primary Examiner*—Hwei-Slu Prayer
(74) *Attorney, Agent, or Firm*—Intellectual Property Law Offices of S. Alex Liao; S. Alex Liao

(57) ABSTRACT

A carpet trimmer comprises a base plate with first slots. Underlying the base plate is a post holder with upstanding threaded posts protruding through the first slots of the base plate. Overlying the base plate is a blade holder that engages the posts for movement with the post holder. A wall guide is formed from the blade holder by bending downwardly in spaced relation to the working edge of the base plate. A first indent is formed on the bottom surface of the blade holder at the junction between the wall guide and the blade holder. The blade holder has a first blade holding recess with a second slot exposed when a blade is in place. A notch on a blade-supporting strip attached on the inner wall of the wall guide, the inner wall, and the first indent forms a second blade holding recess. The first and second recesses define a blade holding area that has a length longer than the blade's length. A blade- retaining member has a second indent which seats into the second slot when securing the blade over the blade holder. Suitable nuts on the posts lock the retaining members over the blades.

12 Claims, 5 Drawing Sheets

Fig-2
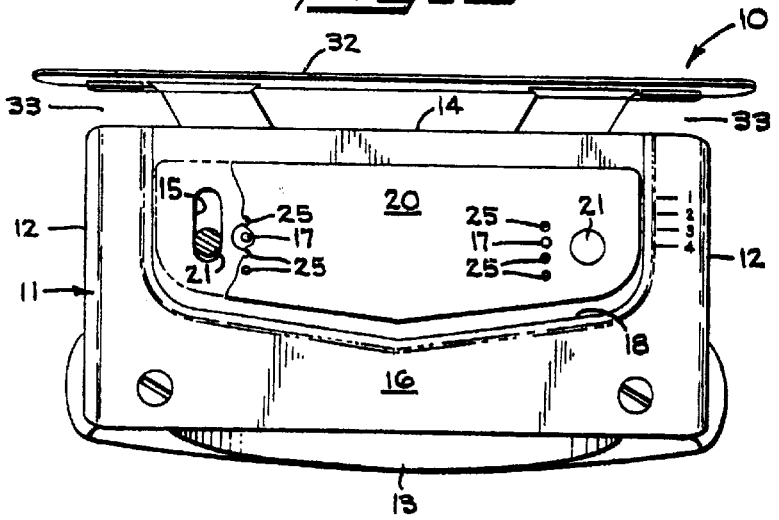
Fig-3
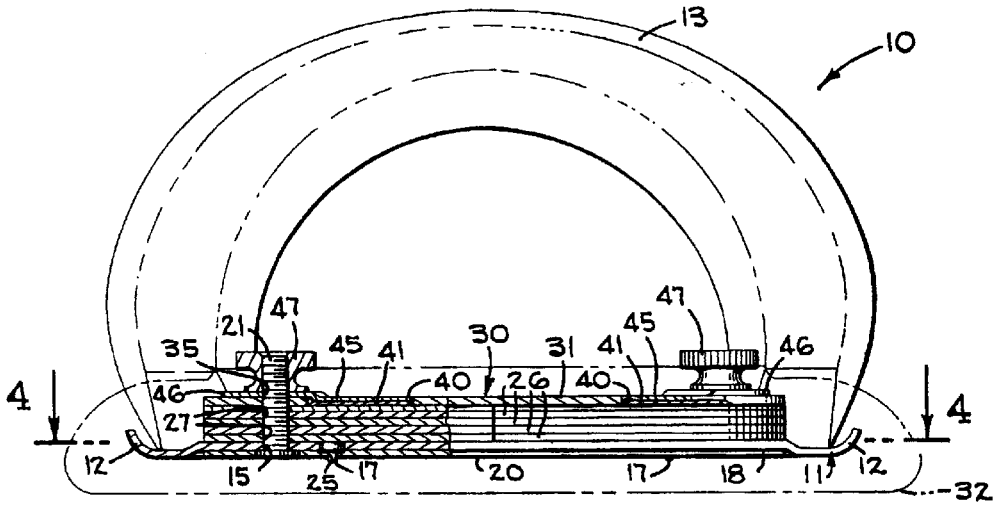
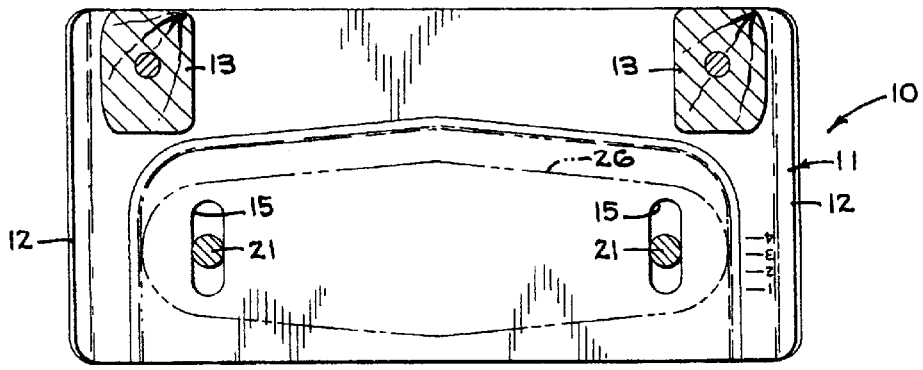
Fig-4

SECTION A-A

SECTION B-B

CARPET TRIMMER

BACKGROUND OF THE INVENTION

1. Field of the Invention

The present invention relates generally to tools for carpet installation, and more particularly, relates to a carpet trimmer 2. Description of the Prior Art The patent issued to Crain U.S. Pat. No. 4,095,341 ("'341 patent") for carpet trimmer discloses a carpet trimmer comprising a base plate, a post holder underlying the base plate, a blade holder, and a blade retaining member having an ear. The base plate has a base, a wall guide, and an upper wall. In a carpet trimmer manufactured by Crain Cutter Company, Milpitas, Calif., which appears to follow the design of '341 patent, the upper wall and wall guide are formed by bending upwardly and then downwardly one edge of the base of the blade holder. A first blade holding recess is formed on the inner wall of the wall guide by stamping and by making a notch on the bended edge of the base of the blade holder. The first blade holding recess holds the free cutting end of a blade. A second blade holding recess is formed on the top of the base for holding the body of the blade, whereby the first recess and the second recess define a blade holding area. The blade fits into the blade holding area perfectly without any horizontal moving room. In addition, the blade-retaining member for holding the blade extends into the first recess to hold the free cutting end of the blade.

However, there are several drawbacks in the tool designed according to '341 patent. The manufacturing of the holding plate is somewhat complex and thus more expensive. It is relatively difficult to make the first recess in the blade holder as disclosed because the manufacturing process involves multiple bending of a metal sheet. Any variation of the material thickness in the metal sheet will cause errors into the locations of any features, i.e., the first recess between the wall guide and the upper wall, which must be stamped into the face of the part itself. Additionally, at the end of the upper wall where the upward bend and downward bend meet, a very small tab is created in order to hold the multiple bends together. The presence of the tab tends to obstruct the flow of the carpet into the blade and also makes the tooling very delicate, which compromises the durability of the stamping die.

In addition, according to the '341 patent, the removal of the blade from the blade holding area is not with ease because the blade fits into the blade holding area perfectly without any space to move horizontally. It is therefore desirable to manufacture the carpet trimmer in a simpler and less expensive way. In addition, it is desirable for a user to change the blade with ease when dealing with a sharp object.

SUMMARY OF THE INVENTION

Therefore, it is an object of the present invention to provide a carpet trimmer, which costs less time and resources to manufacture.

It is another object of the invention to provide a carpet trimmer, which can ride on the carpet more freely within the carpet entry of the carpet trimmer.

It is another object of the invention to provide a carpet trimmer, from which a blade is readily removable with ease.

According to the present invention, a carpet trimmer comprising a base plate. Underlying the base plate is a bottom member with upstanding posts. The base plate is formed with first slots directed at right angles to the working edge of the base plate and the upstanding posts protrude through first slots formed in the base plate. Overlying the base plate is a blade holder, which engages the posts for movement with the bottom member relative to the base plate. The blade holder includes a base and a wall guide being formed by bending one edge of said base downwardly. The base of the blade holder has an indent formed on the bottom surface of the base at the junction with the wall guide. The base overlying said base plate is formed with openings to receive the upstanding posts. The wall guide and the working edge of the base plate define a carpet entry space for receiving an edge of a carpet to be trimmed. The carpet entry space can be adjusted to accommodate carpets of various thicknesses by moving the posts within the first slots formed in the base plate through the simultaneous movement of the bottom member and the blade holder relative to the base plate.

At least one blade is mounted in a blade receiving means formed on the blade holder. The blade projects into the carpet entry space. A securing means on the posts releasably lock the blade holder and the bottom member in an adjusted position relative to the base plate.

According to the invention, the blade receiving means includes a first recess formed on the blade holder for holding the body of the blade and a second recess formed on the inner wall of the guide wall for holding a cutting end of said blade, whereby the first recess, second recess, and the indent on the bottom surface of the base of the blade holder define a blade holding area.

According to the invention, the first recess has a second slot formed at an edge of said first recess away from the wall guide. The blade holding area has a length longer than the length of the body of said blade, whereby the blade may be moved horizontally within said first recess when being removed.

According to the present invention, the second recess is formed by a notched blade supporting strip attached on the inner wall of said wall guide, said inner wall, and said indent on the bottom surface of said base.

According to the invention, the carpet trimmer further comprises a blade-retaining member being disposed above the blade. The blade-retaining member has an ear for receiving the upstanding post and an indent on an edge of the blade-retaining member for seating inside the second open slot of the first recess.

According to the invention, the securing means is above the ear of the blade retaining member to releasably secure the retaining member to the base of the blade holder, whereby the indent of the blade retaining member fitted in the second open slot urges an edge of said blade towards said wall guide and the blade is then secured in the blade holding area.

According to the invention, the carpet trimmer comprises at least one cooperating projection formed on the base plate and a plurality of openings formed on the bottom member. The plurality of the openings are spaced in a direction parallel to the direction of the first slot formed in the base plate, whereby the cooperating projection and spaced openings gauge the desired adjustable movement between the wall guide of the blade holder and the working edge of said base plate, and retain the bottom member in the selected position relative to the base plate.

According to the invention, the carpet trimmer comprises a plurality of individually removable spacer members stacked between the base plate and the base of the blade holder for controlling the distance between the base pate and the base of the blade holder for adjusting the height of the blade relative to the base plate.

According to the invention, the spacer members are formed with vertically aligned openings for receiving the upstanding posts, the movement of the upstanding posts relative to the base plate moves the spacer members therewith relative to the base plate.

According to the invention, the wall means of the base plate is formed with a recess for seating the bottom member therein.

Therefore, the application of the present invention eliminates the need of making multiple bending of a metal sheet during manufacturing of the blade holder. In addition, the removal of the blades will be with ease because of the moving space within the blade holding area. Likewise, the carpet entry point in the trimmer will be smoother because there is no welding point on the junction of multiple bends of the metal sheet that was present in the prior art.

The above and other objects and features of the present invention will be more apparent from the following description taken in conjunction with the accompanying drawings.

BRIFE DESCRIPTION OF THE DRAWINGS

FIG. 2 is a bottom view of the carpet trimmer shown in FIG. 1 with a portion of the post holder plate broken away to illustrate a detent arrangement between the post holder plate and a base plate.

FIG. 3 is a front elevation view of the carpet trimmer shown in FIG. 1 with a wall guide on a blade holding plate broken away to illustrate the stacked spacer plates for blade height adjustment.

FIG. 4 is a horizontal section view taken along line 4—4 of FIG. 3.

DESCRIPTION OF THE PREFERRED EMBODIMENT

Figure 1:
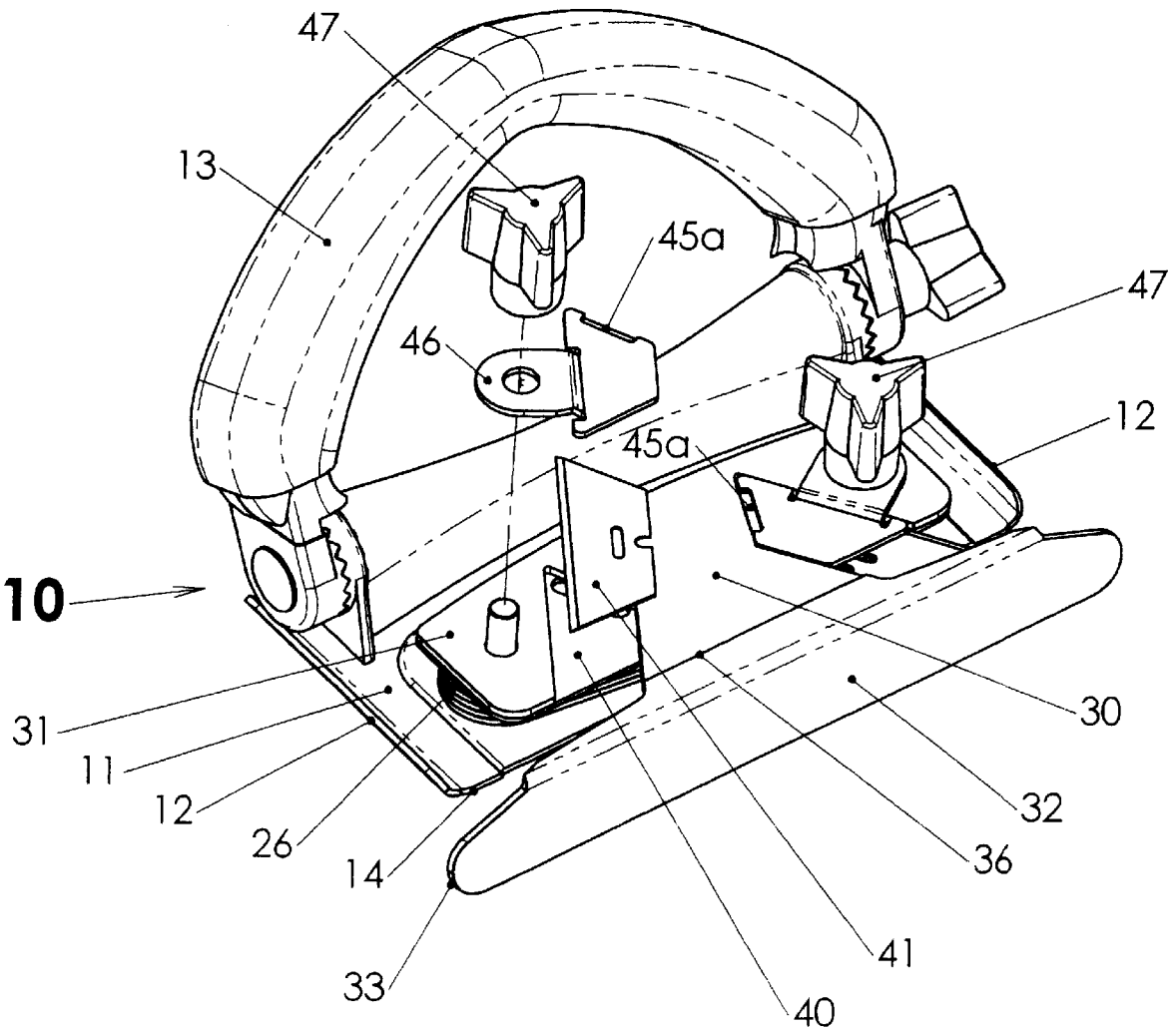
FIG. 1 is a perspective view of a carpet trimmer embodying the present invention.

Referring to FIG. 1, a carpet trimmer 10 employs the present invention comprising a relatively flat base plate 11. The base plate 11, in the preferred embodiment, has a rectangular configuration. At each end thereof, the base plate 11 has an upturned lip 12. Along one side of the base plate 11 is secured suitable handle bar 13, which is adjustable in orientation. Along the opposite side of the base plate 11 is a working edge 14 for the carpet trimmer 10.

By gripping the handle 13, the carpet trimmer 10 is caused to travel in the direction of the working edge 14 and in a direction perpendicular to the upturned lips 12. In practice, the carpet trimmer 10 travels at the option of the user with either upturned lip as the leading end. The carpet trimmer 10 moves along the pile or nap of the carpet with the edge of the carpet to be trimmed engaging the working edge 14 of the base plate 11. The upturned lips 12 serve to reduce the snagging of the carpet at the ends of the base plate 11.

Formed in the base plate 11 are slots 15 (FIG. 2), which are directed at right angles to the working edge 14 of the base plate 11. The carpet riding face 16 of the base plate 11 is formed with indexing projections or detents 17, which project away from the carpet riding face 16. Additionally, the base plate 11 is formed with a recess 18 in the carpet riding face 16 to receive in flush engagement a flat bottom member 20 for holding posts.

The flat bottom member 20 is an adjustable member underlying the base plate 11 that is movable relative to the base plate 11 for adjusting the carpet edge entry space for the carpet trimmer 10 in accommodating the various thicknesses of carpet to be trimmed. The thickness of the adjustable plate 20 is preferably substantially equal to the recess 18 to provide a relatively flat surface for the carpet trimmer 10 in riding over the carpet to be trimmed. Fixed to the adjustable bottom member 20 are upstanding, threaded posts of studs 21 (FIGS. 2–4), which protrude through the slotted openings 15 of the base plate 11. By moving the adjustable bottom member 20, the location of the threaded posts 21 within the slots 15 can be selected.

Also formed in the adjustable member 20 are two sets of openings 25 (FIGS. 2 and 2). Each set of openings 25 are spaced apart in the direction, which the slots 15 are directed. When the adjustable plate 20 is moved to select a location for the threaded posts 21, the projections 17 on the base plate 11 will register with corresponding openings 25 formed in the adjustable member 20 to gauge desired adjustment distances to correspond with known thicknesses of carpets and to retain the adjustable member 20 in its adjusted or selected position relative to the base plate 11.

Removably mounted on the base plate 11 is a stack of flat height adjusting spacer plates 26 (FIGS. 1 and 3). In the preferred embodiment, the height adjusting spacer plates 26 are formed with suitable openings 27 (FIG. 3) therethrough to receive the threaded posts 21. The height of blades for the carpet trimmer 10 is adjusted by adding or removing the spacer plates 26 from the stack mounted on the base plate 11.

Seated on the stack of spacer plates 26 in overlying relation to the base plate 11 is a blade holder 30. The blade holder 30 comprises a relatively flat horizontal base 31, which seats on the spacer plates 26, and comprises a depending wall guide 32. The outer wall of the guide 32 engages the wall of a building along the edge of the carpet to be trimmed. The inner wall of the wall guide 32, which is substantially parallel to the working edge 14 of the base plate 11 (FIG. 1), defines a carpet entry space 33 with the working edge 14 of the base plate 11. The carpet entry space 33 is adjusted by the movement of the wall guide 32 toward or away from the working edge 14 to accommodate various thicknesses of carpets to be trimmed.

Formed in the base 31 of the blade holder 30 are suitable openings 35 (FIG. 5), which receive the threaded posts 21. By moving the adjusting member 20 relative to the base plate 11 to move the threaded posts 21 in selected positions within the slots 15, the blade holder 30 moves therewith relative to the base plate 11 through the urgency or action of the threaded posts 21 for adjusting the carpet entry space 33. In so doing, the distance between the wall guide 32 of the blade holder 30 and the working edge 14 of the base plate 11 is adjusted by moving the blade holder 30 relative to the base plate 11.

Figure 6:
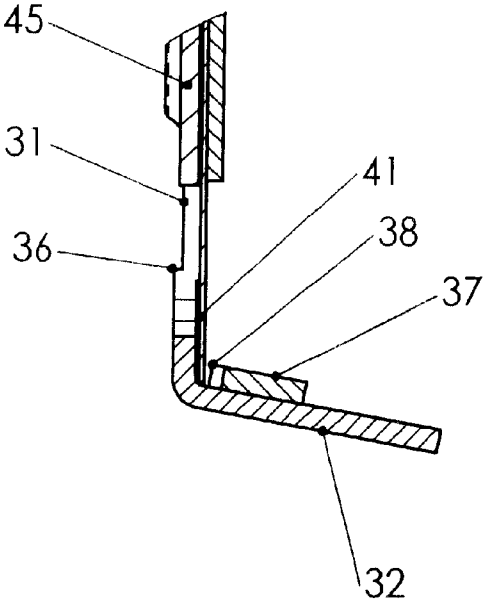
FIG. 6 is a cross section view taken along line A—A of FIG. 5.
Figure 5:
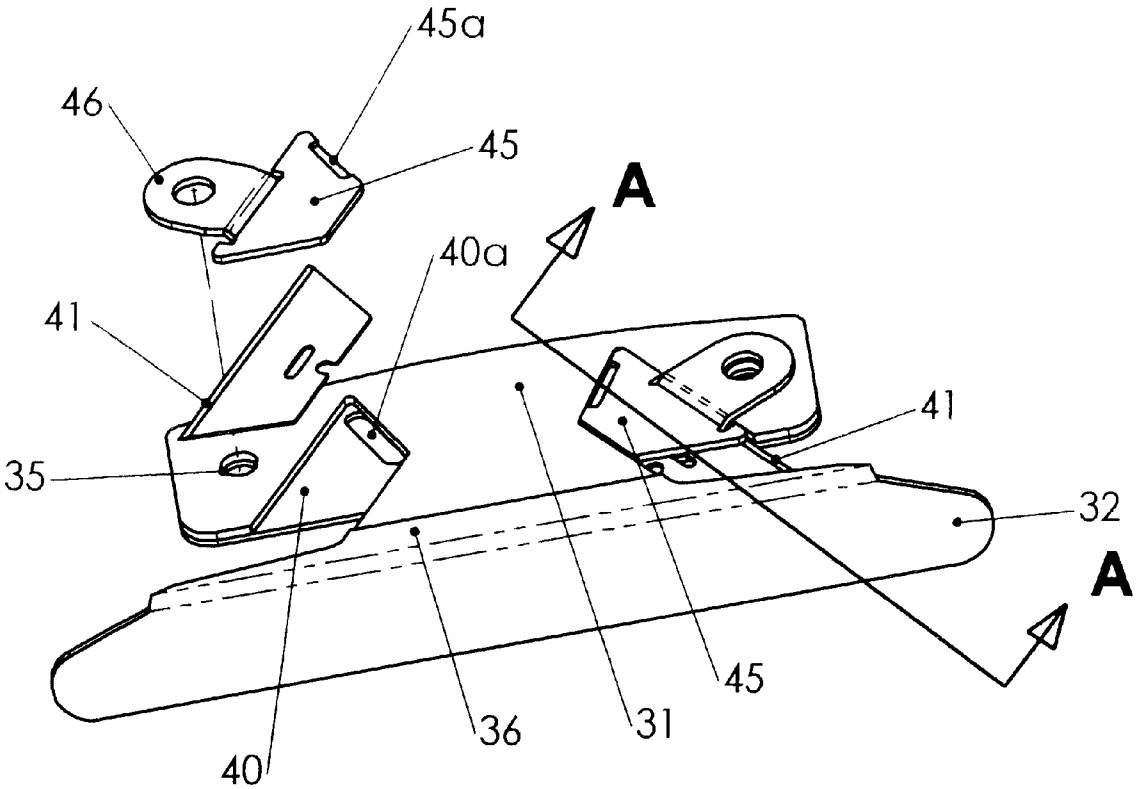
FIG. 5 is a perspective view of the blade holder and the blade-retaining member employing the present invention.
Figure 7:
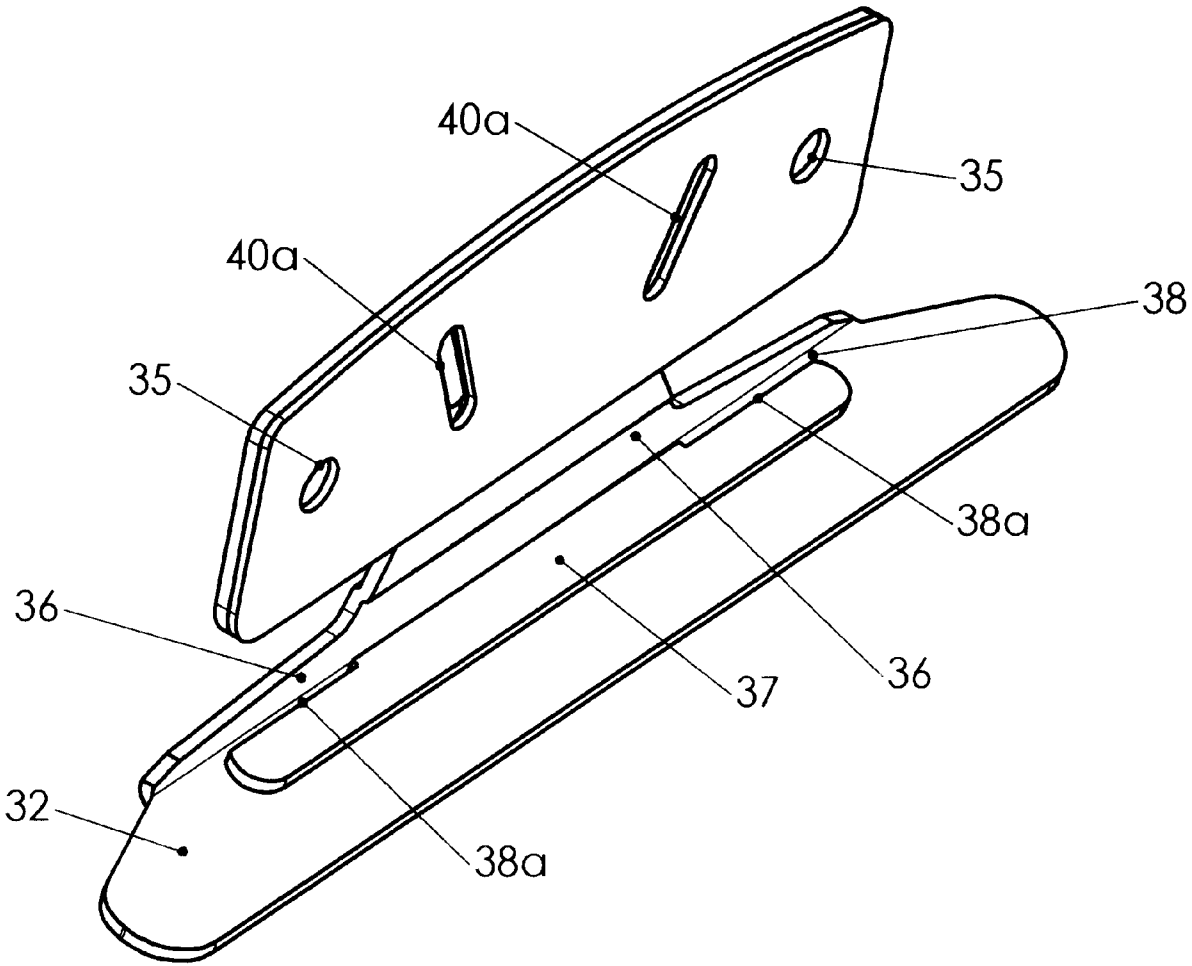
FIG. 7 is a view showing the recess, which holds the free end of the blade on the inner wall of the wall guide.
Figure 9:
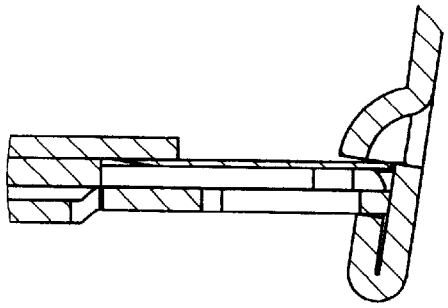
FIG. 9 is a cross section taken along line B—B of FIG. 8.
Figure 8:
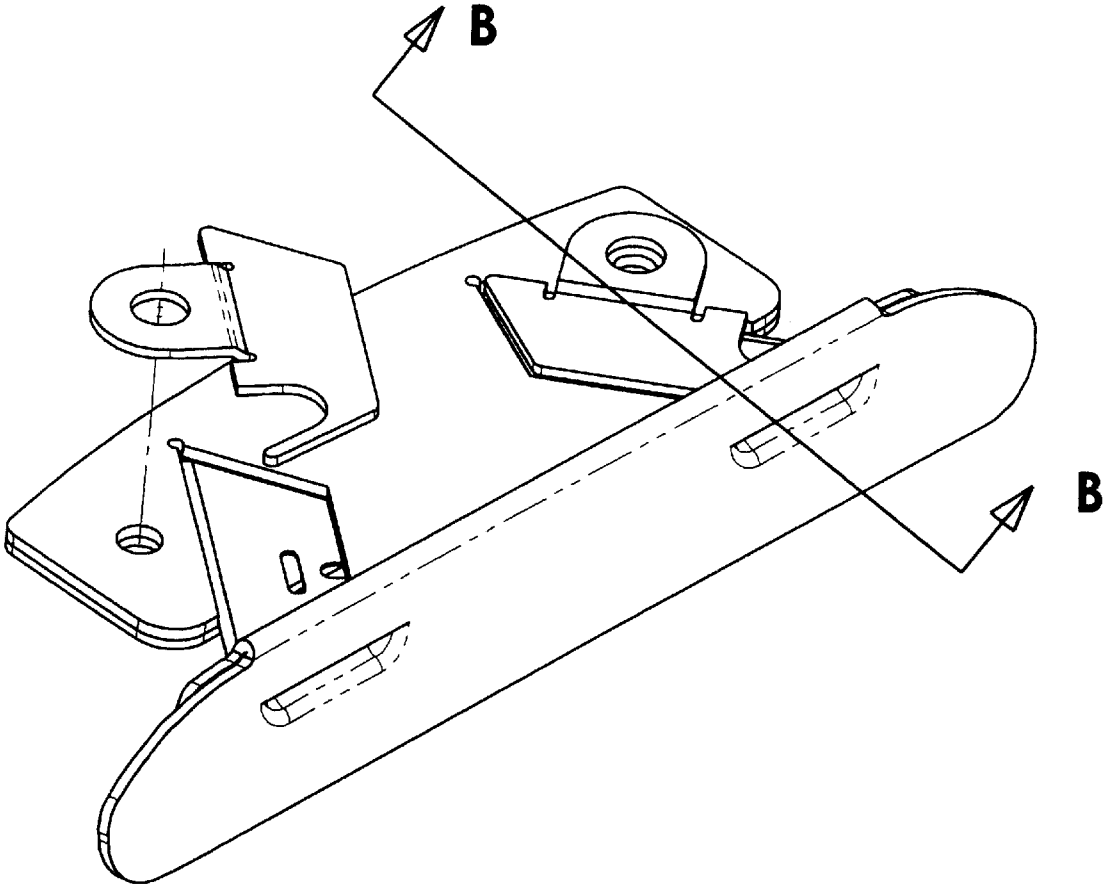
FIG. 8 is a perspective view of the blade holder in the prior art.

Also formed in the base 31 of the blade holder 30 at the junction with the wall guide 32 is an indent 36 at the bottom surface of said base 31 to provide clearance for the blades 41 (FIGS. 1, 5 and 6). Blade supporting areas are formed on the inner wall of the wall guide 32 for supporting the blades 41. A blade-supporting strip 37 attached on the inner wall of the wall guide has a notch 38*a*. The indent 36, the inner wall of the wall guide 32, and the notch 38*a* together form recesses 38 for supporting the cutting ends of blades 41 (FIG. 7).

Formed in the base 31 of the blade holder 30 are recesses 40, which seats the blade 41 in a working manner. The recess 40 has a slot 40*a* away from the wall guide 32. The cutting edges of the blades 41 are facing the adjacent ends of the base plate 11 to be oppositely directed and also to face the leading end of the base plate 11 dependent on the direction of movement of the carpet trimmer 10 and on which blade performs as the cutting blade. The blades are horizontally disposed and the free ends of the blades extend across the carpet entry space in engagement with the recesses 38. When the cutting ends of the blades 41 engages the recesses 38 in the inner wall of the wall guide 32, the slot 40*a* in the recess 40 will be exposed (FIG. 5). The first recess 40 and the second recess 38 define a blade holding area. The blade holding area has a length longer than the length of the body of the blade 41.

Disposed within the recesses 40 are blade-retaining members 45. An ear 46 on each blade-retaining member 45 receives the threaded posts 21. An indent 45*a* is formed on one edge of each blade-retaining member 45. When the retaining members 45 overlie portions of the blades 41 to removably hold the same in place on the blade holder 30, the indents 45*a* will seat in the open slots 40*a* to urge the blades 41 to engage the recess 38 (FIG. 6). Suitable nuts 47 are in threaded engagement with the threaded posts 21 to detachably hold the retaining members 45 in fixed position on the blade holder 30 to lock the blades 41 in place. In addition, this arrangement also serves to releasably secure the adjustment bottom member 20, the spacer members 26 and the blade holder 30 in the adjusted position relative to the base plate 11.

During the removal of the blades 41 fixed on the blade holder 30, after removing the nuts 47 and blade-retaining member 45, the blades 41 can slide horizontally within the blade holding area. The blades 41 can then be taken out of the recesses 40 with ease. The installation of the blades 41, which is the reverse of the removal process, can also be done with ease.

In the operation of the carpet trimmer 10, the height of the blades 41 is adjusted by either adding or removing spacer plates 26 from the stack thereof between the base plate 11 and the base 31 of the blade holder 30. In this manner, the desired cutting height is established and the extent of trimmed edge of the carpet to be tucked into the space in back of the tack strip is provided. Additionally, the nuts 47 are loosened to enable the adjusting bottom member 20 to be moved relative to the base plate 11. In so doing the threaded posts 21 are moved in selected positions within the slots 15 formed in the base plate 11. The projections 17 on the base plate 11 and the selected openings 25 formed in the adjusting member 20 serve as a gauge to select predetermined adjustment distances for widths of carpets and to retain the adjusting bottom member 20 in the adjusted position, relative to the base plate 11. The movement of the threaded posts 21 in the selected positions within the recesses 15 of the base plate 11 moves the blade holder 30 relative to the base plate 11 to vary the carpet entry space 33 between the working edge 14 of the base plate 11 and the wall guide 32 to accommodate various thicknesses for carpets to be trimmed. After the adjustment is made, the nuts 47 are tightened to retain the blade holder 30 and the adjustment bottom member 20 in the adjusted position relative to the base plate 11.

In the use of the carpet trimmer 10, the carpet riding face 16 of the base plate 11 rides on the pile or nap of a carpet with the edge of the carpet to be trimmed disposed in the carpet entry space 33 engaging the working edge 14 of the base plate 11 and the wall guide 32 of the blade holder 30. The handle bar 13 moves the carpet trimmer 10 in the direction of the working edge 14 causing either one of the blades 41 to trim the edge of the carpet disposed in its path of travel. The cutting blade 41 that performs the cutting operation depends on the direction of travel of the carpet trimmer 10.

During the replacement of the blade 41, the blade 41 can slide out horizontally from the recess 38 and be removed with ease after removing the nut 47 and the retaining member 46.

I claim:

1. A carpet trimmer comprising:

a base plate, said base plate being relatively flat and comprising a wall means for traveling over a carpet to be trimmed, said wall means being formed with a working edge and at least a first slot directed at right angles to said working edge;

a handle mounted on said base plate for moving said base plate along a path extending in the direction of said working edge;

a relatively flat bottom member underlying said base plate and movable relative to said base plate;

at least one upstanding post fixed to said bottom member and projecting through said first slot formed in said base plate;

a blade holder comprising a base and a wall guide, said wall guide being formed by bending one edge of said base downwardly, said base having an indent formed on the bottom surface of said base at the junction to said wall guide, said base overlying said base plate and being formed with an opening to receive said upstanding post, said wall guide being spaced from said working edge of said base plate to define a carpet entry space for receiving an edge of a carpet to be trimmed, the movement of said bottom member relative to said base plate moves said upstanding post therewith within said first slot for said upstanding post to urge said blade holder to move therewith relative to said base plate for adjusting the space between said working edge of said base plate and said wall guide of said blade holder to accommodate the width of a carpet disposed in said carpet entry space to be trimmed;

at least one blade mounted in a blade receiving means formed on said blade holder, said blade projecting into said carpet entry space for trimming a carpet, and securing means on said at least one upstanding posts to releasably lock said blade holder and said bottom member in an adjusted position relative to said base plate.

2. A carpet trimmer according to claim 1, wherein said blade receiving means includes a first recess formed on said base of said blade holder for holding the body of said blade and a second recess formed on the inner wall of said wall guide for holding a cutting end of said blade, whereby said first recess and second recess define a blade holding area.

3. A carpet trimmer according to claim 2, wherein said second recess is defined by a notch on a supporting strip attached on said inner wall of said wall guide, said inner wall, and said indent at the bottom surface of said base, wherein, said blade holding area has a length longer than the length of said blade.

4. A carpet trimmer according claim 3, wherein said second recess is formed by the bottom wall of said indent of said base, said notch on said supporting strip securely attached on said inner wall of said wall guide, and said inner wall of said wall guide.

5. A carpet trimmer according to claim 4, wherein said first recess has a second slot at an edge of said first recess away from said wall guide, said blade holding area has a length longer than the length of the body of said blade, whereby said blade may be moved horizontally within said blade holding area when being removed.

6. A carpet trimmer according to claim 5 and comprising a blade retaining member disposed above said blade, said blade retaining member having an ear for receiving said upstanding post and an indent on an edge of said blade retaining member for seating in said second slot of said first recess.

7. A carpet trimmer according to claim 6, wherein said securing means is above said car to releasably secure said retaining member to said base of said blade holder, whereby said indent of said blade retaining member urges an edge of said blade towards said wall guide and said blade is secured in said blade holding area.

8. A carpet trimmer according to claim 7, wherein said upstanding post is threaded and said securing means is threaded for threaded engagement with said post.

9. A carpet trimmer according to claim 8, and comprising at least one cooperating projection formed on said base plate, and a plurality of openings formed on said bottom member and spaced in a direction parallel to the direction of said first slot formed in said base plate, whereby said cooperating projection and spaced openings gauge the desired adjustable movement between said wall guide of said blade holder and said working edge of said base plate and retain said bottom member in the selected position relative to said base plate.

10. A carpet trimmer according to claim 9, and comprising a plurality of individually removable spacer members stacked between said base plate and said base of said blade holder for controlling the distance between said base pate and said base of said blade holder for adjusting the height of said blade relative to said base plate.

11. A carpet trimmer according to claim 10, wherein said spacer members are formed with vertically aligned openings for receiving said upstanding post, the movement of said upstanding post relative to said base plate moves said spacer members therewith relative to said base plate.

12. A carpet trimmer according to claim 11, wherein said wall means of said base plate is formed with a recess for seating said bottom member therein.

* * * * *